US006658697B2

(12) United States Patent
Liao

(10) Patent No.: US 6,658,697 B2
(45) Date of Patent: Dec. 9, 2003

(54) MAGNETIC GLASS DOOR HOLDER

(76) Inventor: Shou Hsing Liao, 5 Fl., No. 159, Sec. 1, Huamei W. St., Taichung (TW)

( * ) Notice: Subject to any disclaimer, the term of this patent is extended or adjusted under 35 U.S.C. 154(b) by 0 days.

(21) Appl. No.: 10/066,588

(22) Filed: Feb. 6, 2002

(65) Prior Publication Data

US 2003/0145428 A1 Aug. 7, 2003

(51) Int. Cl.[7] ..... E05C 17/56; E05C 19/16
(52) U.S. Cl. ..... 16/82; 292/251.5; 24/303
(58) Field of Search ..... 16/82, 83, 85; 292/251.5; 24/303

(56) References Cited

U.S. PATENT DOCUMENTS 2,521,885 A * 9/1950 Vazquez ..... 292/251.5
3,734,553 A * 5/1973 Sugasawara ..... 292/251.5
4,505,502 A * 3/1985 Tomita ..... 292/251.5
4,669,766 A * 6/1987 Hanchett et al. ..... 292/251.5
4,941,235 A * 7/1990 Aoki ..... 24/303
5,010,622 A * 4/1991 Morita ..... 16/85
5,836,049 A * 11/1998 Chiang ..... 16/82
5,887,917 A * 3/1999 Luciana ..... 292/251.5

* cited by examiner

*Primary Examiner*—Anthony Knight
*Assistant Examiner*—William D Hutton, Jr.
(74) *Attorney, Agent, or Firm*—Troxell Law Office PLLC

(57) ABSTRACT

A magnetic glass door holder includes a position device fixed on a mobile door and a fix device fixed on a stationary door, and a sucking device respectively provided hidden in the position device and the fix device. Then the two sucking devices suck each other to keep the mobile door from receiving shocks to secure it in an opened or closed position. The magnetic glass door holder can be applied to a frameless tempered glass door consisting of a stationary one and a mobile door combined in an angle such as 90°, 135° or 180°.

3 Claims, 6 Drawing Sheets

MAGNETIC GLASS DOOR HOLDER

BACKGROUND OF THE INVENTION

This invention relates to a magnetic glass door holder, particularly to one capable to prevent shock and ensure positioning of a mobile frameless tempered glass door so as to be applied to a single door, and a mobile door and a stationary one combined in an angle of 90°, 135° or 180°

A known conventional magnetic door holder shown in FIG. 1 generally includes a magnetic plate 2 fixed on a door, and a stopper 3 fixed on a wall. The stopper 3 has a magnet 4 in a front end to stop and suck the magnetic plate 2 so as to hold the door immovable in the opened position when the glass door is opened. Thus the door is prevented from being blown closed by a wind.

The conventional door holder looks extremely protruding out, having to be hidden behind a wooden door or metal door for keeping its appearance neat. The conventional door is holder impossible to be applied on a glass door as it can be applied on a wooden or metal door only. But if it is applied to a glass door, it may look quite protruding out, as the glass door is transparent. Besides, the magnet exposes out, having no buffer function so that the glass door may be apt to produce breaking owning to shocks caused by collision of the stopper with the magnet plate.

The conventional magnetic door holder can only be applied to a wooden or metal door located before a wall, impossible to be applied to a frameless glass door or an angled door, etc.

SUMMARY OF THE INVENTION

One purpose of the invention is to offer a magnetic glass door holder provided with a position device and a fix device, and a sucking device respectively affixed hidden on the position device and the fix device, and the sucking devices have a buffer gasket to prevent a mobile glass door from receiving shocks and also ensure to keep it in the closed position when it is closed Another purpose of the invention is to offer a magnetic glass door holder having a position device provided with plural lateral columns extending laterally from the position column, and a locking device fixed on one of the lateral columns so that the lateral column may be locked on a stationary door, and another has a sucking device to suck another sucking device fixed on a stationary door so as to secure a single door or a mobile one and a stationary one combined together in an angle such as 90°, 135° or 180° in a closed position.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
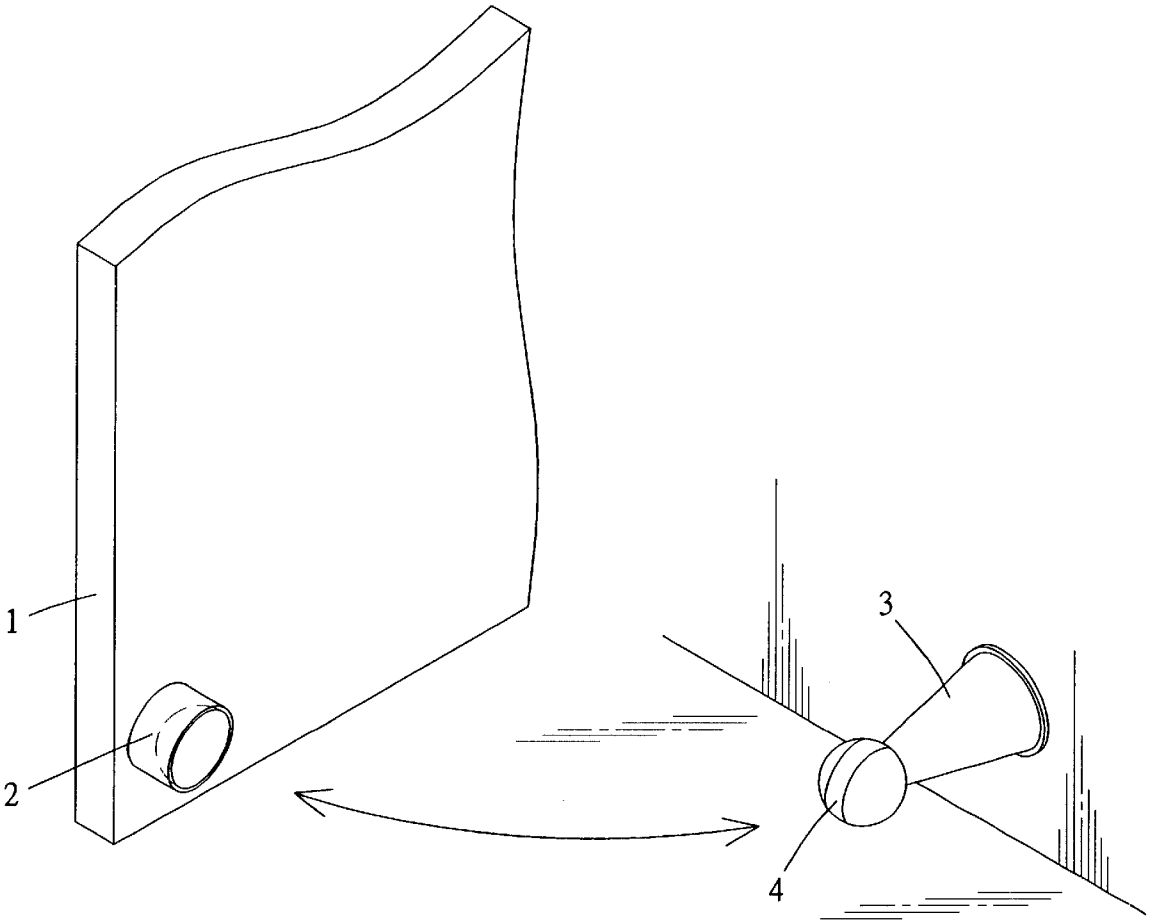
FIG. 1 PRIOR ART
FIG. 1 is a perspective view of a known conventional magnetic door holder.
Figure 2:
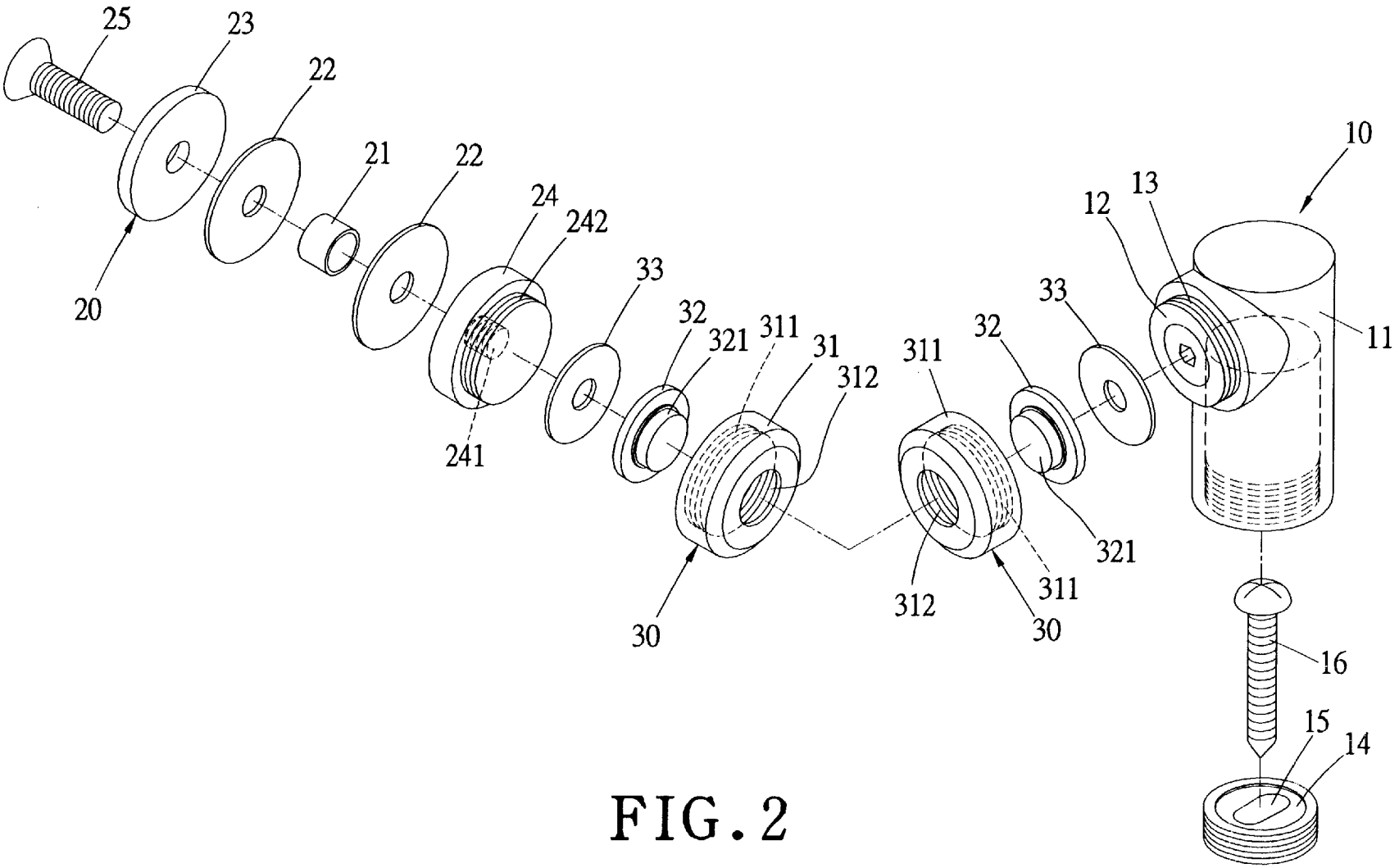
FIG. 2 is an exploded perspective view of a first embodiment of a magnetic glass door holder in the present invention.
Figure 3:
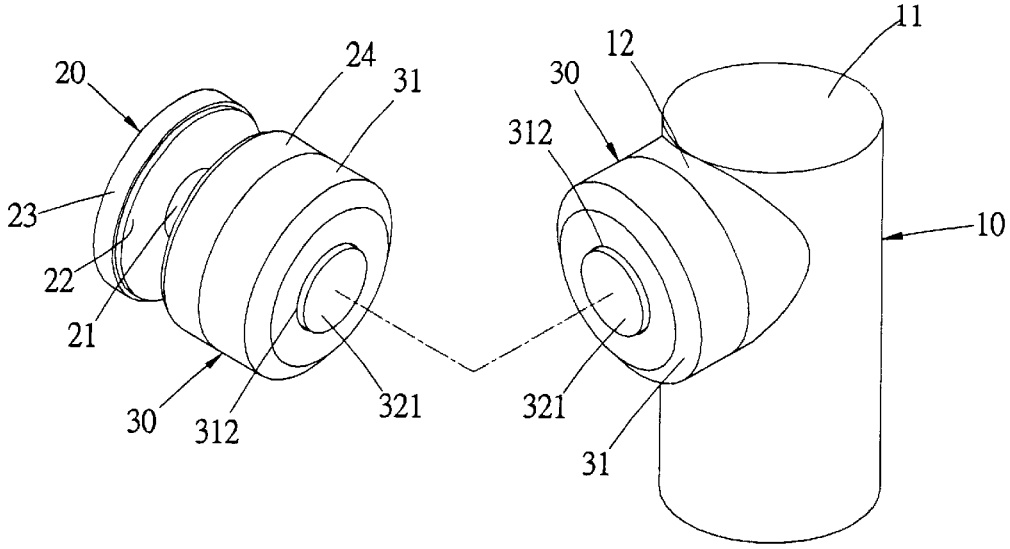
FIG. 3 is a perspective view of the first embodiment of a magnetic glass door holder in the present invention.
Figure 4:
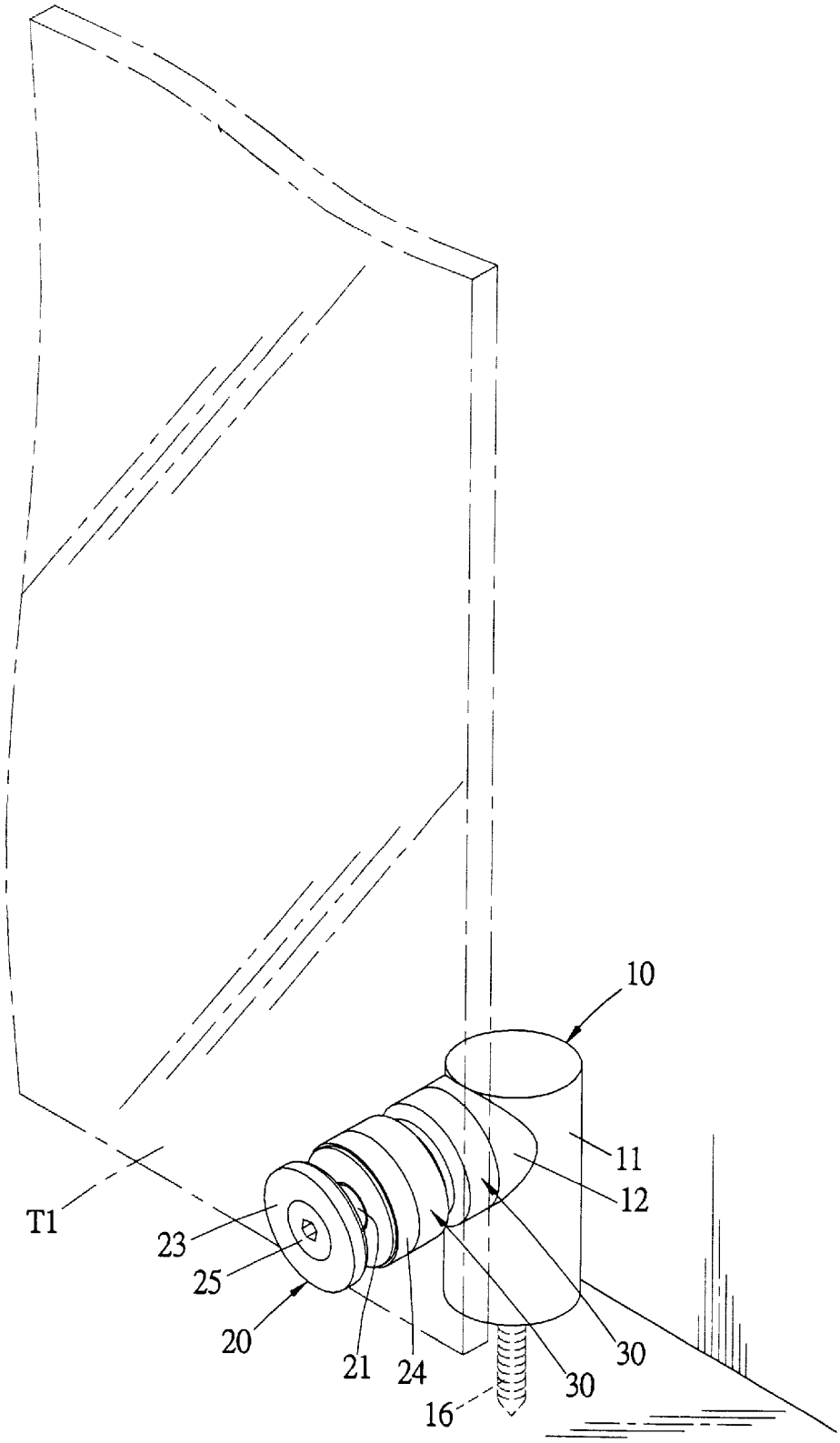
FIG. 4 is a perspective view of the first embodiment of a magnetic glass door holder applied to a glass door in the present invention.

A first embodiment of a magnetic glass door holder in the present invention, as shown in FIGS. 2, 3 and 4, includes a position device 10, a fix device 20, two sucking devices 30 as main components combined together.

The position device 10 consists of a position column 11 provided with a lateral column 12 extending laterally from an outer surface of the position column 11, male threads 13 formed on the lateral column 12, a nut 14 with a slot 15 screwing with female threads formed in a vertical hole in a substantial length of a lower portion of the position column 11, and a bolt 16 partly located in the vertical hole of the position column and passing through the slot 15 of the nut 14 to extend in the ground or a wall to secure the position column 11 after the position column 11 is adjusted a little by moving the bolt 16 in the slot 15, if necessary.

The fix device 20 consists of a sleeve 21 embedded in a hole bored in a mobile door T1, a washer 22 respectively placed before and behind the sleeve 21 and at two sides of the mobile door T1, a fix washer 23 and a fix base 24 respectively positioned outside each of the washers 22, and a locking bolt 25 passing through the sleeve 21, the washers 22, the fix washer 23 and engaging a threaded hole 241 of the fix base 24. Further, the fix base 24 has male threads formed on the other end.

The two sucking devices 30 respectively screw with the lateral column 12 and the fix device 20. Each sucking device 30 includes a sleeve 31, a magnet 32, and a spacer 33. The sleeve 31 is provided with female threads 311 to engage with the male threads 13 of the position device 10 or with the male threads 242 of the fix base 24, and a center hole 312.

The magnet 32 is fitted in the sleeve 31, having a buffer gasket 321 formed in a front end, and exposing out of the hole 312 of the sleeve 31.

The spacer 33 is made of non-metal, positioned behind the magnet 32, keeping the magnet 32 from contacting with other components.

Next, how to assemble and use the magnetic glass door holder is to be described. As shown in FIGS. 3 and 4, the locking bolt 16 locks the nut 14 screwed with the position column 11 on the ground or a wall, and then the position column 11 with the nut 14 is capable to be adjusted in its position a little by means of the locking bolt 16 movable in the slot 15, if necessary. After that, the magnet 32 and the spacer 33 are placed in the sleeve 31, with the female threads 311 engaging with the male threads 13 of the position column 11.

Then the sleeve 21 is inserted in a hole bored in the mobile door T1, and the washers 22 are respectively placed before and behind the sleeve 21 and at an inner side and the outer side of the mobile door T1. Further, the fix washer 23 and the fix base 24 are respectively placed at two sides of the mobile door T1. Then the locking bolt 25 locks the fix device 20 on the mobile door T1, and one of the sucking devices 30 is screwed tightly with the fix base 241, with the female threads 311 of the sleeve 31 engaging the male threads 242 of the fix base 241.

When the mobile door T1 is opened and contacts the positioned device 10, the two magnets 32 of the two sucking devices 30 suck each other, securing the mobile door in the stopped position. Meanwhile the buffer gaskets 321 of the magnets 32 buffer the two sucking devices 30 when they come to contact each other so that the glass door may not be broken. This is one of the advantages of the invention. In addition, the position device 10 and the fix device 20 and the sucking devices 30 are all shaped circular, giving a balanced appearance, not damaging impression of the whole glass door, and elevating worthiness of a glass door.

Figure 5:
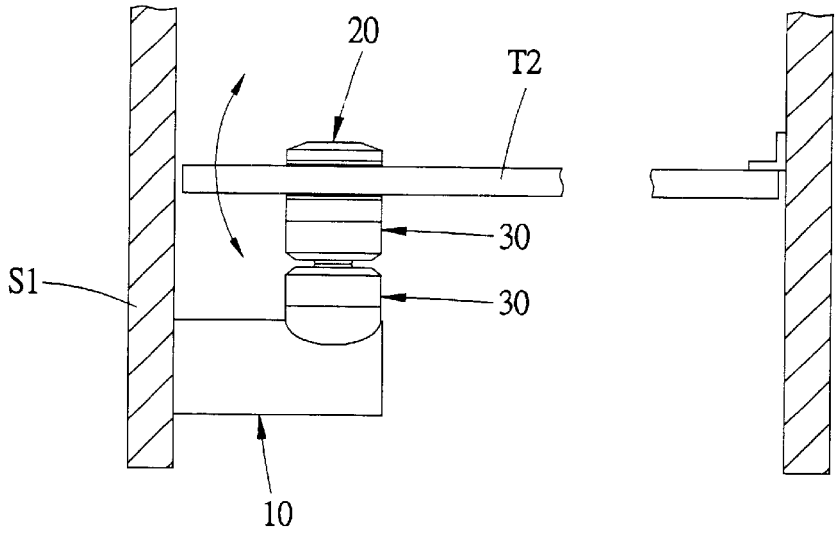
FIG. 5 is an upper view of a second embodiment of a magnetic glass door holder applied to a glass door in the present invention.

Moreover, the fix device 20 may be positioned on an upper edge of a mobile door T2, as shown in FIG. 5, and the position device 10 is fixed on a wall corresponding to the mobile door T2. Then it may not become an obstacle to be tipped over by a person as it is positioned on the ground.

Figure 7:
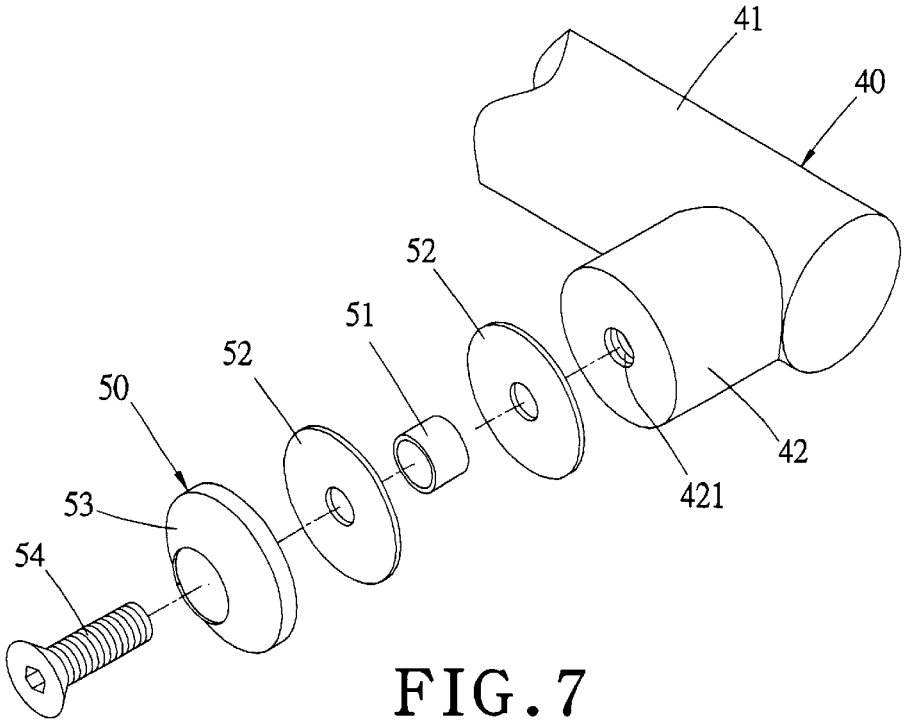
FIG. 7 is an exploded perspective view of a locking device in the third embodiment of a magnetic glass door holder in the present invention.
Figure 6:
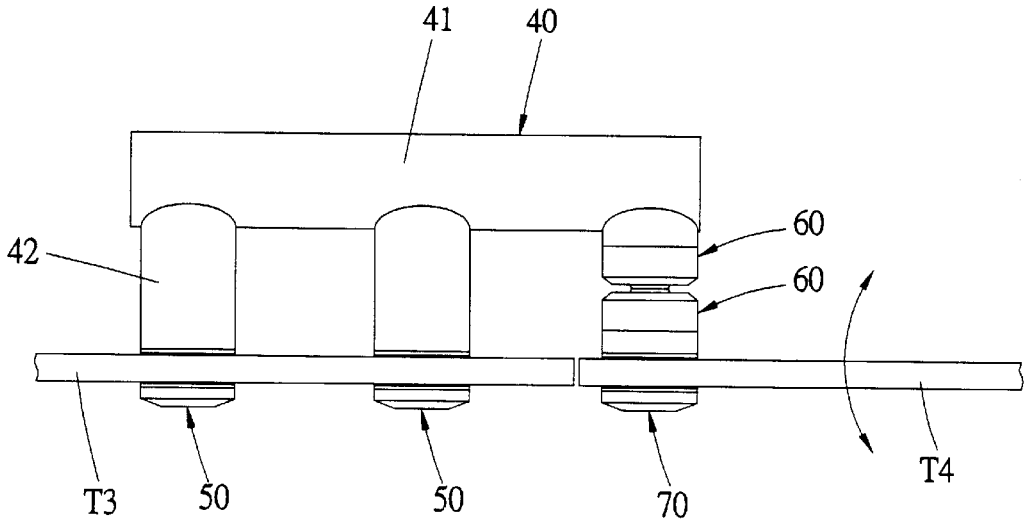
FIG. 6 is an upper view of a third embodiment of a magnetic glass door holder applied to a stationary glass door and a mobile glass door in the present invention.

Next, FIGS. 6 and 7 show respectively a second and a third embodiment of a magnetic glass door holder in the invention, having a position device 40 provided with a position column 41 comparative longer than that in the first embodiment, and a sucking device 60 fixed on the position column 41 additionally provided with two extension columns 42, which have respectively a threaded hole 421 in a lower end surface. Each extension column 42 has a locking device 50 provided with a sleeve 51 to be fitted in a hole of a stationary door T3. A washer 52 is positioned before and behind the sleeve 51 and located at an inner and an outer side of the stationary door T3. A clamping disc 53 is placed outside of the outer washer 52, and a locking bolt 54 passes through the sleeve 51, the two washers 52 and the clamping disc 53 and further engaging the threaded hole 421 of the extension column 42, forming two locking devices 50 fixed on the stationary door T3. Thus, the position column 41 of the position device 40 is secured in parallel with the stationary door T3, but the sucking devices 60 are located near the mobile door T4. The mobile door T4 is the same as that in the first embodiments, having a sucking device on one side and a fix device 70 on the other side.

Figure 8:
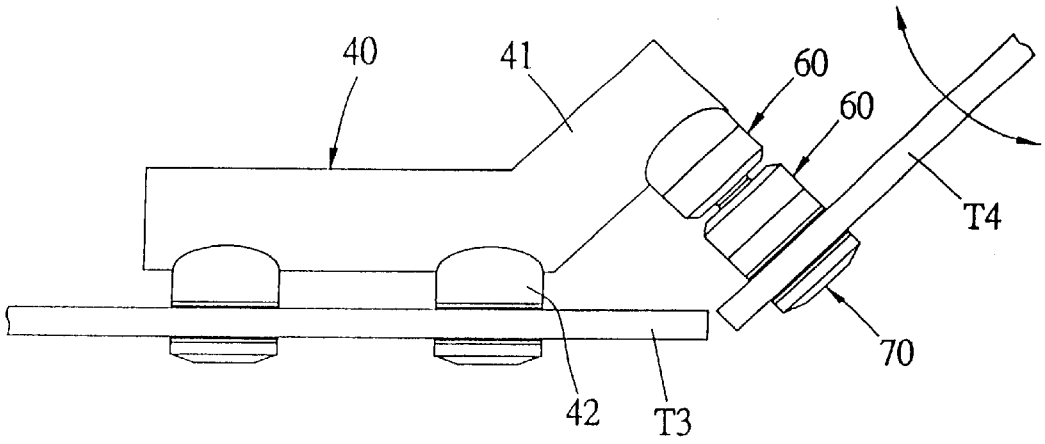
FIG. 8 is an upper view of a fourth embodiment of a magnetic glass door holder in the present invention; and, FIG. 9 is an upper view of a fifth embodiment of a magnetic glass door holder applied to a glass door in the present invention.
Figure 9:
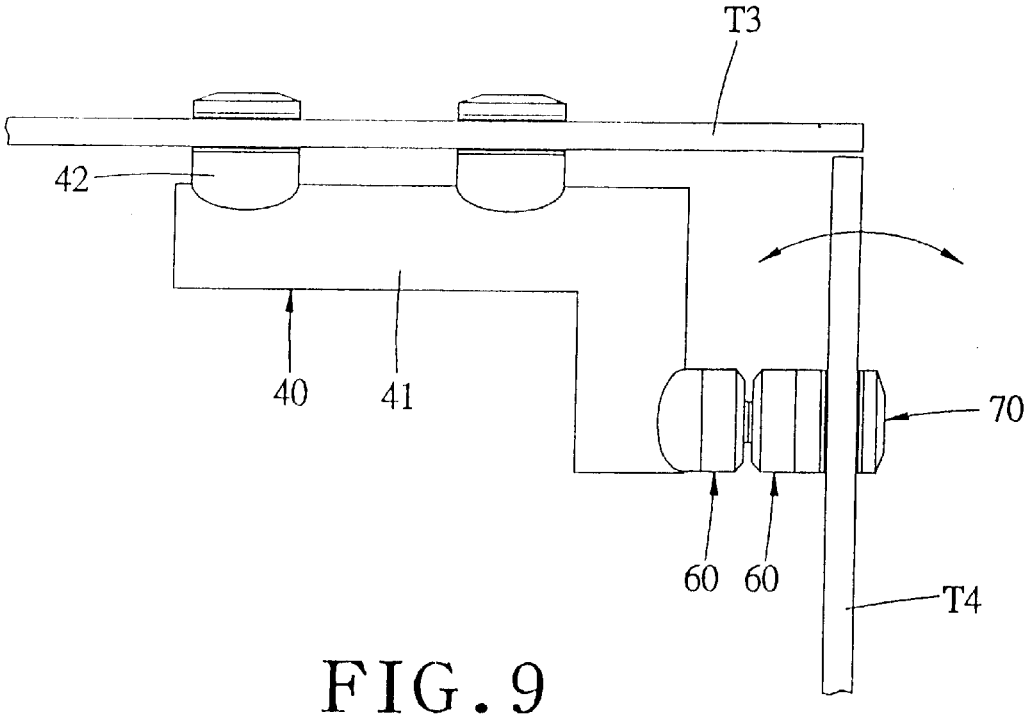

Next, FIGS. 8 and 9 show respectively a fourth and fifth embodiment of the invention, having respectively a position column 41 of the fix device 40 shaped curved for an angle or vertically curved to suit to an angled door or a vertical door.

While the preferred embodiments of the invention have been described above, it will be recognized and understood that various modifications may be made therein and the appended claims are intended to cover all such modifications that may fall within the spirit and scope of the invention.

I claim:

1. A magnetic glass door holder comprising: a position device fixed on a stationary door, a fix device fixed on a mobile door, and a sucking device respectively fixed on a front portion of said position device and of said fix device;

each said sucking device comprising:

a sleeve fitted around a front end of said position device or of said fix device, having a center hole;

a magnet placed in said sleeve and having a buffer gasket in a front end exposing out of said center hole of said sleeve: and, a spacer made of non-metal and located behind said magnet to keep said magnet from contacting other components, wherein said fix device consists of a sleeve to be fitted in a hole bored in the mobile door, washers respectively positioned before and behind said sleeve of the fix device, a fix washer, a fix base, and a locking bolt passing through said sleeve, said washers, said fix washer and engaging a threaded hole of said fix base, said fix base has male threads formed in another end each said sleeve of each sucking device has female threads formed in another end, and said male threads of said fix base engage said threads of said sucking device to secure said sucking device to said fix device.

2. A magnetic glass door holder comprising: a position device fixed on a stationary door, a fix device fixed on a mobile door, and a sucking device respectively fixed on a front portion of said position device and of said fix device;

each said sucking device comprising:

a sleeve fitted around a front end of said position device or of said fix device, having a center hole;

a magnet placed in said sleeve and having a buffer gasket in a front end exposing out of said center hole of said sleeve; and, a spacer made of non-metal and located behind said magnet to keep said magnet from contacting other components, wherein said position device has a preset number of lateral columns laterally extending from an outer surface of a position column, at least two locking devices are fixed on two of said lateral columns to secure firmly said lateral columns on the stationary door, at least one of said lateral column has a sucking device so that said sucking device may suck a sucking device fixed on a fix device fixed on the mobile door to keep the mobile door immovable.

3. The magnetic glass door holder as claimed in claim 2, wherein each said locking device consists of a sleeve to be fitted in a hole bored in the stationary door, a washer respectively positioned before and behind said sleeve, and a clamping disc positioned outside the outermost washer, and a locking bolt passing through said sleeve, said washers, said clamping disc and further in a threaded hole of said lateral column.

* * * * *